US011992108B2

(12) United States Patent
Leroux et al.

(10) Patent No.: US 11,992,108 B2
(45) Date of Patent: May 28, 2024

(54) DEVICE FOR PACKAGING, DISPENSING AND APPLYING A SOLID OR PASTY BLOCK OF COSMETIC PRODUCT

(71) Applicant: L'OREAL, Paris (FR)

(72) Inventors: Stéphane Leroux, Clichy (FR); Alain Berhault, Clichy (FR)

(73) Assignee: L'Oreal, Paris (FR)

( * ) Notice: Subject to any disclaimer, the term of this patent is extended or adjusted under 35 U.S.C. 154(b) by 245 days.

(21) Appl. No.: 17/423,644

(22) PCT Filed: Jan. 23, 2020

(86) PCT No.: PCT/EP2020/051678
§ 371 (c)(1),
(2) Date: Jul. 16, 2021

(87) PCT Pub. No.: WO2020/169301
PCT Pub. Date: Aug. 27, 2020

(65) Prior Publication Data

US 2022/0087400 A1 Mar. 24, 2022

(30) Foreign Application Priority Data

Feb. 20, 2019 (FR) ..... 1901679

(51) Int. Cl.
*A45D 40/20* (2006.01)
*A45D 40/26* (2006.01)
*A45D 40/00* (2006.01)

(52) U.S. Cl.
CPC ..... *A45D 40/262* (2013.01); *A45D 40/205* (2013.01); *A45D 2040/0018* (2013.01); *A45D 2040/208* (2013.01)

(58) Field of Classification Search
CPC ..... A45D 40/02; A45D 40/04; A45D 40/06; A45D 40/08; A45D 40/18; A45D 40/20;
(Continued)

(56) References Cited

U.S. PATENT DOCUMENTS 1,971,127 A 8/1934 Arnold et al.
2,521,928 A * 9/1950 Mauro ..... A46B 11/0055 222/386

(Continued)

FOREIGN PATENT DOCUMENTS

EP 1 913 835 A1 4/2008
EP 1 958 536 A1 8/2008
EP 3 415 035 A1 12/2018

OTHER PUBLICATIONS

International Search Report dated May 17, 2020 in PCT/EP2020/051678 filed on Jan. 23, 2020, citing documents AA-AF and AO-AQ therein, 3 pages.

*Primary Examiner* — Rachel R Steitz
(74) *Attorney, Agent, or Firm* — Christensen O'Connor Johnson Kindness PLLC

(57) ABSTRACT

Device for packaging, dispensing and applying a solid or pasty block of cosmetic product The present application relates to a device for packaging, dispensing and applying a block of solid or pasty cosmetic product, comprising a longitudinal tubular case having an open first end, intended for dispensing the cosmetic product, and an opposite second end that is closed by a base accommodating a mechanism for driving a support for holding said cosmetic product in translation along the case, characterized in that the device has, at the open first end of the case, an external envelope with a longitudinal central axis offset radially with respect to a longitudinal central axis of an external envelope of the device at the opposite end of the case that is closed by the base.

13 Claims, 1 Drawing Sheet

(58) Field of Classification Search
CPC ..... A45D 40/205; A45D 40/262; A45D 2040/0018; A45D 2040/0062; A45D 2040/204; A45D 2040/208; A45D 2200/1072
See application file for complete search history.

(56) References Cited

U.S. PATENT DOCUMENTS

| | | | | |
|---|---|---|---|---|
| 2,978,722 | A * | 4/1961 | Kusakabe | A46B 11/002 401/176 |
| 2008/0095566 | A1 | 4/2008 | Thiebaut et al. | |
| 2009/0232578 | A1 | 9/2009 | Grossnass et al. | |
| 2016/0081454 | A1 | 3/2016 | Booth et al. | |
| 2017/0251787 | A1* | 9/2017 | Kudo | A45D 34/042 |
| 2017/0280854 | A1 | 10/2017 | Booth et al. | |
| 2018/0020809 | A1* | 1/2018 | Soga | A45D 40/06 401/88 |
| 2019/0008260 | A1* | 1/2019 | Wilson | A45D 34/04 |
| 2019/0150593 | A1 | 5/2019 | Booth et al. | |

* cited by examiner

DEVICE FOR PACKAGING, DISPENSING AND APPLYING A SOLID OR PASTY BLOCK OF COSMETIC PRODUCT

The present invention relates to an assembly for packaging, dispensing and applying a block of cosmetic product that is solid or pasty at the application temperature.

The expression "cosmetic product" is understood to mean any product as defined in Regulation (EC) No 1223/2009 of the European Parliament and of the Council of Nov. 30, 2009 on cosmetic products. Thus, a cosmetic product is generally defined as being a substance or a mixture intended to be brought into contact with superficial parts of the human body (epidermis, body-hair and head-hair systems, nails, lips, and external genitalia) or with the teeth and the oral mucous membranes in order, exclusively or mainly, to cleanse them, fragrance them, modify their appearance, protect them, keep them in good condition, or correct body odors.

In the scope of the present application, the cosmetic product is in particular a cosmetic product for making up or caring for a body surface of a user. It may notably be a composition for making up the eyelashes or eyebrows, a cosmetic composition for treating the eyelashes or eyebrows, a makeup base, or a composition known as a "top coat" to be applied on top of a first layer that has itself already been applied to the eyelashes or eyebrows. It could in particular be a solid mascara for the eyelashes or eyebrows.

A block of cosmetic product is understood to be a mass of product that retains its shape when it is removed from its packaging device, unlike a product in a more or less viscous fluid form, which flows and does not retain its shape outside its packaging device.

As indicated above, the terms solid or pasty are understood as relating to the state of the cosmetic product at the application temperature, generally ambient temperature. More specifically, for reference, the temperature could be about 20° C. and the atmospheric pressure could be 760 mmHg. More generally, the solid or pasty product according to the present application is considered to have a hardness greater than 30 $Nm^{-1}$, preferably greater than 35 $Nm^{-1}$. The hardness is measured using the method described in the application US2015/0320673, which is incorporated by reference.

Conventionally, such cosmetic products manufactured in the form of a block, such as sticks of lipstick or lip balm, are generally packaged in devices that form a case and allow them to be dispensed and applied by partial extension of the block of cosmetic product out of the case. After application, the block of cosmetic product can optionally be retracted into the case until it is used again.

The case has a rectilinear tubular overall shape, notably with a cylindrical, oval or elongate section, and has an open first end, intended for dispensing the cosmetic product in the form of a block or stick, and an opposite second end that is closed by a base accommodating a mechanism for driving a support (cup) for said cosmetic product in the form of a block in translation. The support, or cup, which is movable in translation is thus commonly referred to as a lift or elevator. The case thus forms a sleeve for packaging, dispensing and applying the cosmetic product in the form of a stick. The first, dispensing end is referred to as the front or upper end and the second, driving end is referred to as the rear or lower end.

There are many drive systems for the support. According to one particularly widespread embodiment, at least an actuating part of the base is prevented from moving in translation with respect to the case but is rotatable, while the support is movable in translation and prevented from rotating with respect to this same case. A helical groove system combined with one or more guide pins converts the rotational movement of the actuating part of the base into a movement of the support in translation so as to bring about the extension or retraction of the cosmetic product with respect to the case. According to the embodiments, the guide pins can be secured to the support or to the base.

Displacement of the movable support toward the open front end causes the cosmetic product to partially emerge from the case, while displacement of said movable support in the opposite direction brings about the retraction of the product into this same case. Some devices may be equipped with means for blocking the support that only allow the latter to be displaced in the direction of dispensing of the cosmetic product and prevent the retraction of said product into the case.

The open front end is generally equipped with a removable cover for protecting the cosmetic product and for limiting the evaporation of volatile compounds (drying) if need be.

This type of packaging, which is particularly widespread for lipsticks, also exists for mascaras, as described in the document US20070104531A1, and for the eyebrows (eyebrow pen).

As illustrated in the abovementioned document US20070104531 for soft mascaras, the case may bear, around its dispensing opening, elements for combing and separating the eyelashes. In the embodiment variant in FIG. 16, the sleeve or case has a row of standing separating/combing elements that extend radially toward the outside of the lateral perimeter of said sleeve.

The positioning of these combing/separating elements close to the dispensing orifice for the product has a significant ergonomic advantage. Specifically, such dispensing pens that are equipped with a brush or a comb mounted at the rear end, opposite to the dispensing end, of said pen are known. This configuration makes it necessary to almost constantly turn the pen around in order to alternate between application and combing/separation.

In the case of such a lateral comb, a major drawback is that, on account of the presence of the removable cover, the space actually available for the comb is extremely small and the latter can only have one row of elements, themselves having a relatively small size.

Therefore, there is a need for such a dispensing and application assembly that has a larger space between one side of the case and an internal surface of the cover such that it is possible to house a larger lateral combing element that is more suitable for better combing of the eyelashes or eyebrows therein.

Thus, the document EP1913835A1 shows a device for packaging, dispensing and applying a block of solid or pasty cosmetic product, comprising a longitudinal tubular case having an open first end, intended for dispensing the cosmetic product, and an opposite second end that is closed by a base accommodating a mechanism for driving a support for holding said cosmetic product in translation along the case, characterized in that the device has, at the open first end of the case, an external envelope with a longitudinal central axis offset radially with respect to a longitudinal central axis of an external envelope of the device at the opposite end of the case that is closed by the base.

Thus, by providing a case of which the front-end and rear-end portions are not aligned and of which the respective longitudinal central axes do not coincide, said case has a non-rectilinear external envelope, as a result freeing up a large space on a front side of said case.

Specifically, the internal dimensions of a cover intended to be fitted on said case are determined mainly by the section of the external envelope of the device at the second end, to which this cover is fastened in the closed position. The offset between the first end and the second end of the case, and more specifically the fact that the first end is off-center with respect to the second end and the base of said case, therefore frees up the necessary space between a front lateral wall of the case and an internal wall of said cover. This internal space can be used to house a complementary application element of larger size compared with the existing prior art.

The expression "at the end" is understood as meaning a longitudinal portion of the case that extends from said end over a sufficient distance to house the desired complementary application element.

Preferably, the block of cosmetic product is in the form of a stick. Preferably, the cosmetic product is a product for eyebrows, notably a mascara for eyebrows.

Advantageously, an overall section of the external envelope at the first end is inscribed entirely within an overall section of the external envelope at the second end. More specifically, along the case, the largest section of the device, determining the internal dimensions of the attached cover, is at the second end. The smallest section of the device is, for its part, at the open first end. The overall section of the external envelope of the device advantageously decreases continuously along the case from the second end to the open first end.

Advantageously, the case has at least one rectilinear lateral portion from the second end to the first end and at least one non-rectilinear lateral portion from the second end to the first end. The non-rectilinear lateral portion makes it possible to provide a discontinuity or transition zone between the two axially offset external envelopes.

Further advantageously, an overall section of the external envelope of the device at the open first end of the case covers less than 70%, preferably less than 60%, of an overall section of the external envelope of the device at the second end of the case.

Preferably, the complementary section of the external envelope of the device at the open first end of the case, that is to say the overall section at the second end, which is not covered by the overall section of the first end, comprises a continuous zone that represents at least 80%, if not all of said complementary section. Thus, virtually the entire freed-up space forms a single free space or one that represents at least 80% of the complementary section.

Preferably, the complementary section of the external envelope of the device at the open first end of the case is mostly situated on the opposite side of the longitudinal central axis of the external envelope of the device at said open first end from the longitudinal central axis of the external envelope of the device at the base.

Advantageously, the case has a rectilinear internal duct, preferably of constant section, notably elongate, extending preferably in a longitudinal direction of said case. The internal duct can of course have some other section, notably a circular or arcuate section. Alternatively, the duct can be inclined slightly with respect to the longitudinal direction of the case.

In a complementary manner, the device comprises a removable cap configured to engage with the external envelope of the device at the second end of the case or behind said second end over an external envelope of the device in the region of the driving base for the support.

Preferably, the cap has an internal section, notably a circular section, that is substantially constant in a longitudinal direction of said cap, said longitudinal direction coinciding with the central axis of the external envelope of the second end of the case when the cap is in place.

According to one particular embodiment, the case has, at its open first end, a substantially elongate overall section of external envelope, a major axis of said elongate section extending notably in a direction substantially perpendicular to the direction of the offset between the longitudinal central axes. With such an elongate section, a relatively large substantially flat lateral surface is thus available for housing the desired complementary application element. The overall section of the open first end can also be oval, in particular with a relatively small degree of curvature on its long sides.

In an advantageously complementary manner, the case has, at its second end closed by the base, a substantially circular and more generally rotationally symmetric overall section. Such a section makes it possible to easily attach a driving base having a rotary movement.

According to the present invention, the case bears, close to the open first end, at least one complementary application element protruding laterally from a lateral wall of the external envelope in at least the direction of the offset between the longitudinal central axes from the central axis of the first end toward the central axis of the second end.

A complementary application element is understood to be, in a nonlimiting manner: combing elements, notably as mentioned in the document US20070104531A1, a set of teeth and/or spikes, a flocked surface, a foam applicator and/or a felt surface (adhesively-bonded or welded elements), a textured or non-textured flexible elastomer surface (element preferably overmolded), or a metal element having a sufficient volume to provide a refreshing effect.

These complementary application elements can notably make it possible to homogenize and smooth the product applied or even to remove the excess. These elements, notably foams or felts, can also make it possible to blend the product after application. A combing element will make it possible to separate and align, or even straighten the keratin fibers after application.

Preferably, the combing elements, teeth, spikes, flock fibers are arranged in a plurality of longitudinal rows disposed in an adjacent manner at a periphery of the case. Given the greater available space, numerous configurations of the combing elements, and more generally of the complementary element, are possible.

The complementary application element may also be a second cosmetic product such as a product in the form of compact powder, a solid cake, eyeshadow.

The present application also relates to a method for making up the eyelashes or eyebrows, comprising a step of applying a makeup or care product in the form of a stick to the eyelashes or eyebrows by means of a device according to the invention. Preferably, the method comprises a subsequent step of using a complementary application element of the device.

The invention may be understood better on reading the following description, accompanied by nonlimiting implementation examples thereof, with reference to the appended drawings, in which:

FIG. 1 shows a device 1 for packaging, dispensing and applying a makeup product in the form of a makeup pen, the cosmetic product being a stick of cosmetic product (not shown), in this case an eyebrow mascara.

Figure 2:
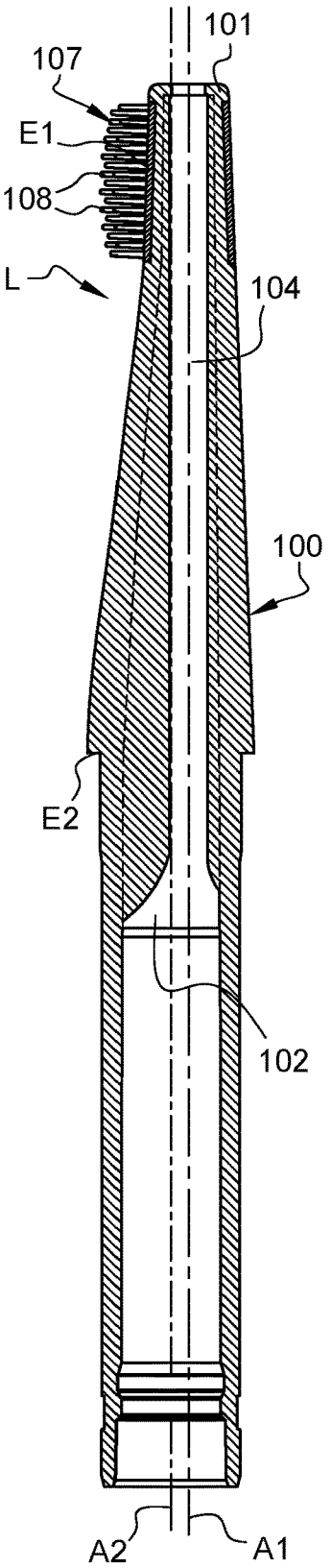
FIG. 2 is a view in longitudinal section of a case belonging to the device in FIG. 1.
Figure 3:
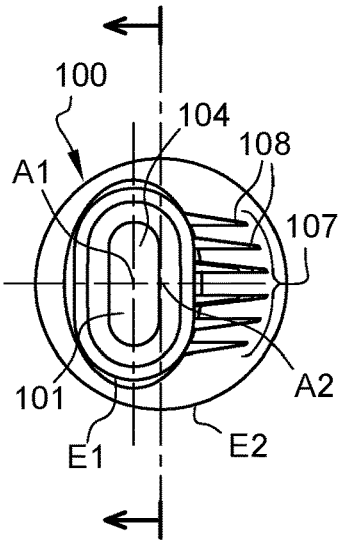
FIG. 3 is a front view of the case in FIG. 2.

The device 1 comprises a longitudinal tubular case 100, shown on its own in FIGS. 2 and 3. The case 100 has an open first end 101, intended for dispensing the cosmetic product, and an opposite second end 102, intended to be closed by a base 200.

The case 100 has a rectilinear internal duct 104, preferably of constant section, in this case elongate, extending in a longitudinal direction of said case 100, and in particular in the direction of a longitudinal central axis of an external envelope E1 of the first end 101, from said first end 101 to the second end 102 closed by the base 200.

The base 200 accommodates a mechanism for driving a support 103 for holding said cosmetic product in translation along the case inside the duct 104. Conventionally, the base 200 comprises an actuating part 201 that is prevented from moving in translation with respect to the case 100 but is rotatable. For its part, the support 103 is movable in translation and prevented from rotating with respect to this same case 100. A helical groove system 203 combined with one or more guide pins 205 converts the rotational movement of the actuating part of the base into a movement of the support 103 in translation so as to bring about the extension or retraction of the cosmetic product with respect to the case. In order to accommodate the rotary drive mechanism, the case 100 has, at its second end 102 closed by the base 200, a substantially circular and more generally rotationally symmetric overall section.

As explained above, the rotation of the actuating part 201 in a first direction drives the movable support 103 toward the open front end 101, and causes the cosmetic product to partially emerge from the case 100. Rotation of the actuating part 201 the other way drives said movable support 103 in the opposite direction, causing the product to retract into this same case 100.

Figure 1:
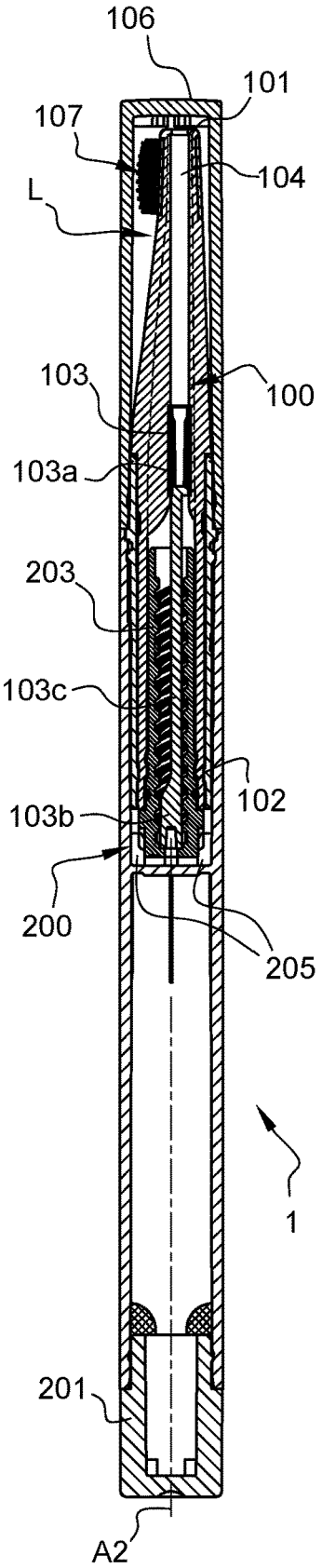
FIG. 1 is an overall view, in longitudinal section, of a packaging, dispensing and application device according to the present application.

In a complementary manner, the device 1 comprises a removable cap 106 intended to cover at least a front portion of the case 100 and configured to engage with an external envelope E2 of the device at the second end 102 of the case 100 or behind said second end 102 over an external envelope of the device 1 in the region of the driving base 200 for the support 103. The cap 106 has a cylindrical overall shape with a substantially constant circular internal section in a longitudinal direction of said cap 106. A longitudinal central axis of the cap coincides with a longitudinal central axis A2 of the external envelope E2 of the second end 102 of the case 100 when the cap is in place (FIG. 1).

According to the present application, the device 1 (apart from any cap) has, at the open first end 101 of the case 100, an external envelope E1 with a longitudinal central axis A1 offset radially with respect to a longitudinal central axis A2 of an external envelope E2 of the device 1 at the opposite end 102 of the case that is closed by the base 200.

The fact that the first end is off-center with respect to the second end and the base of said case, and thus of the longitudinal central axis of the cap 106 when it is in the closed position, thus frees up a larger lateral space L between a front lateral wall of the case 100 and an internal wall of the cover 106.

This lateral space L can be used to house a complementary application element 107 with greater dimensions compared with the existing prior out, both in terms of the height projecting from the case 100 and in width over the periphery of the case 100. More particularly, the complementary application element 107 could have a longitudinal size greater than 0.7 cm and/or a peripheral size greater than 0.5 cm.

The expression "at the end" is understood as meaning a longitudinal portion of the case that extends from said end over a sufficient distance to house the desired complementary application element. In particular, the longitudinal portion extends over at least 1 cm, preferably up to around 2 cm.

As can be seen in FIG. 3, an overall section of the external envelope E1 at the first end 101 is inscribed entirely within an overall section of the external envelope E2 at the second end 102.

In particular, the largest section of the device 1 along the case, determining notably the internal dimensions of the attached cap 106, is located at the second end 102. The smallest section of the device 100 is, for its part, at the open first end 101. The overall section of the external envelope of the device 1 decreases continuously along the case 100 from the second end 102 to the open first end 101. More specifically, the case 100 has a non-rectilinear lateral portion from the second end 102 to the first end 101, which forms a discontinuity forming a transition zone between the two, axially offset, external envelopes E1, E2.

In the particular case shown, the external envelope E1 of the case is substantially elongate, a major axis of said elongate section extending notably in a direction substantially perpendicular to the direction of the offset between the longitudinal central axes A1, A2. With such an elongate section, a relatively large substantially flat lateral surface is thus available for housing the desired complementary application element 107.

As can also be seen in FIG. 3, a complementary section of the external envelope E1 of the device 1 at the open first end 101 of the case is substantially continuous and is mostly situated on the opposite side of the longitudinal central axis A1 of the external envelope E1 of the device 1 at said open first end 101 from the longitudinal central axis A2 of the external envelope E2 of the device 1 at the second end 102 closed by the base 200.

The complementary application element 107 protrudes laterally from a lateral wall of the external envelope E1 substantially in the direction of the offset between the longitudinal central axes A1, A2 and from the central axis A1 of the first end 101 to the central axis A2 of the second end 102. More specifically, the complimentary application element extends within the complimentary section and notably in the continuous part situated on the opposite side of the longitudinal axis A1 from the axis A2.

In the present case, the complementary application element 107 is a brush comprising a set of spikes 108 arranged in a plurality of longitudinal rows over a peripheral portion of the external envelope E1. Of course, numerous other configurations are possible given the available space L.

This complementary application element 107 of the brush type can notably make it possible to homogenize and smooth the product applied to the eyebrows or even to remove the excess.

As regards the drive mechanism and the support 103, said support 103 comprises, on one side, a front cup 103*a*, intended to support the stick of cosmetic product and to push it through the duct 104, and, on the other side, an anchor 103*b* bearing the guide pins 205 in the helical groove 203. The cup 103*a* and the anchor 103*b* are connected by a rod

103*c* or stem that is long enough to cover the travel of the cup 103*a* along the duct 104 and consequently of the anchor 103*b* along the groove 203.

The cup 103*a* is aligned with the longitudinal central axis of the duct 104, coinciding substantially with the central axis A1, while the anchor 103*b* is substantially aligned with the longitudinal central axis A2 of the second end 102. On account of the misalignment between the central axis A1 and the central axis A2, the rod 103*c* cannot be aligned with either of these two axes.

According to a first embodiment as shown in FIG. 1, the rod 103*c* is rectilinear but secured to the cup 103*a* and the anchor 103*b* in a slightly off-center manner with respect to at least one or both of these elements depending on the respective dimensions and the size of the offset.

Alternatively, according to a second embodiment that is not shown, it is possible to realize a rod that has a sufficiently small thickness to have a degree of flexibility allowing slight deformation during the displacement. The rod can thus be connected to the cup 103*a* and/or to the anchor 103*b* at the centers thereof.

The invention claimed is:

1. A device for packaging, dispensing and applying a block of solid or pasty cosmetic product, comprising:

a longitudinal tubular case having an open first end, intended for dispensing the cosmetic product, and an opposite second end that is closed by a base accommodating a mechanism for driving a support for holding said cosmetic product in translation along the case; and an external envelope at the open first end of the case, the external envelope having a longitudinal central axis offset radially with respect to a longitudinal central axis of an external envelope of the device at the opposite end of the case that is closed by the base, wherein the case bears, close to the open first end, at least one complementary application element protruding from a lateral wall of the external envelope in at least the direction of the offset between the longitudinal central axes from the central axis of the first end toward the central axis of the second end, wherein the support for holding the cosmetic product is connected to the mechanism for driving in translation via a substantially rectilinear rod, a longitudinal axis of the rod is off-center with respect to a longitudinal axis of said support and to the drive mechanism.

2. The device as claimed in claim 1, wherein a section of the external envelope of the device at the open first end of the case covers less than 70% of a section of the external envelope of the device at the second end of the case.

3. The device as claimed in claim 2, wherein a complementary section of the external envelope of the device at the open first end of the case comprises a continuous zone that represents at least 80% of said complementary section.

4. The device as claimed in claim 3, wherein the complementary section of the external envelope of the device at the open first end of the case is situated on the opposite side of the longitudinal central axis of the external envelope of the device at the open first end from the longitudinal central axis of the external envelope of the device at the base.

5. The device as claimed in claim 1, wherein the case has a rectilinear internal duct, preferably of constant section, notably elongate, extending preferably in a longitudinal direction of said case.

6. The device as claimed in claim 1, further comprising a removable cap configured to engage with the external envelope of the device at the base of the case or behind said base over the external envelope of the device in the region of the drive mechanism for the support.

7. The device as claimed in claim 6, wherein the cap has an internal section that is substantially constant in a longitudinal direction of said cap, said longitudinal direction coinciding with the central axis of the second end of the case when the cap is in place.

8. The device as claimed in claim 1, wherein the case has, at its opening, a substantially elongate section of external envelope, a major axis of said elongate section extending notably in a direction substantially perpendicular to the direction of the offset between the longitudinal central axes.

9. The device as claimed in claim 1, wherein the case has, at its second end closed by the base, an external envelope of substantially circular section.

10. The device as claimed in claim 1, wherein the support for holding the cosmetic product is connected to the mechanism for driving in translation via a rod that exhibits flexibility allowing slight deformation, said rod being connected to the holding support and to the drive mechanism substantially at their center.

11. The device as claimed in claim 1, wherein the cosmetic product is a product for eyebrows.

12. A method for making up the eyelashes or eyebrows, comprising:

a step of applying a makeup or care product in the form of a stick to the eyelashes or eyebrows by means of a device as claimed in claim 1.

13. The makeup method as claimed in claim 12, further comprising:

a subsequent step of using a complementary application element of the device, the complementary application element protruding from the lateral wall of the external envelope in at least the direction of the offset between the longitudinal central axes from the central axis of the first end toward the central axis of the second end.

* * * * *